United States Patent [19]

Crocket

[11] 4,340,241

[45] Jul. 20, 1982

[54] SKI

[76] Inventor: Danial E. Crocket, 1334 Whites Rd., Kalamazoo, Mich. 49008

[21] Appl. No.: 139,746

[22] Filed: Apr. 14, 1980

[51] Int. Cl.[3] ..... A63C 5/04

[52] U.S. Cl. ..... 280/609

[58] Field of Search ..... 280/609, 610, 608, 601, 280/602, 607, 21 A, 28

[56] References Cited

U.S. PATENT DOCUMENTS

| | | | |
|---|---|---|---|
| 2,277,281 | 3/1942 | Vinton | 280/601 X |
| 2,616,715 | 11/1952 | Billings | 280/609 X |
| 3,501,161 | 3/1970 | Holmberg et al. | 280/610 |
| 3,503,621 | 3/1970 | Schmidt et al. | 280/610 |
| 3,921,994 | 11/1975 | Locati | 280/607 |

FOREIGN PATENT DOCUMENTS

| | | | |
|---|---|---|---|
| 210624 | 7/1940 | Switzerland | 280/11.13 |
| 265869 | 3/1946 | Switzerland | 280/609 |

*Primary Examiner*—Robert R. Song

*Attorney, Agent, or Firm*—Gordon W. Hueschen

[57] ABSTRACT

There is disclosed a ski which has a tip portion, a tail portion, a boot support portion, and parallel runners unitarily united at the tip portion, the tail portion, and the boot support portion and providing a channel running the full length of the bottom of the ski, the channel, forward and rearward of the boot support portion, being open from the bottom to the top thereof. One or more bridges affixed to the tops of said runners and spanning open portions of the channel may be provided. Also, if desired, the portion of the channel under the boot support portion may be partially filled in.

20 Claims, 8 Drawing Figures

SKI

FIELD OF INVENTION AND PRIOR ART

This invention relates to a ski and is particularly directed to improvements in a ski of the type having a tip portion bent up to form the ski shovel, a tail portion, a boot platform portion positioned to support and distribute the weight of the skier, a forward portion extending forwardly from the boot platform portion through the tip portion, and a rearward portion extending rearwardly from the boot platform portion through the tail portion. Skis of the class described are commonly made of wood, metal, plastic, reinforced plastic, laminates, and composites. They are used generally for snow skiing. Ordinarily the tail portion is bent up slightly, but not so much as the tip portion.

Skis of the class described are tailored to meet the needs of the individual skier. Thus, skis for racing have a greater taper than skis for recreational use. Also, with skis for racing, the boot support portion and the forward and rearward portions are constructed so that the pressure zone under the boot is small and less of the pressure is distributed to the tip and tail, whereas in recreational skiing, the design is such that there is a relatively long pressure zone under the boot platform portion so that the pressure is more evenly distributed from the tip to the tail. The latter are more suited for making skidded turns, whereas the former are best suited for making carved, parallel turns where the ski must be on edge with the ski bent to increase the pressure applied at the tip and tail portions of the ski. Such turns are also facilitated by tapering the ski back from the shovel.

In between these two extremes is a wide range of possibilities suited for different purposes and for persons of different skills.

A typical ski of the class described is shown in U.S. Pat. No. 3,503,621. It may be characterized as a fiberglas reinforced plastic laminate composite. It is characterized also, as are many such skis, by a longitudinal groove in the running surface extending from the shovel to the tail. A similar snow ski is seen in U.S. Pat. No. 3,501,161.

It has been proposed, in order to facilitate ski maneuvers such as turns, to provide a ski which is longitudinally split from the rear end or heel to a point adjacent the midpoint, where the ski bindings are affixed. This provides two parallel, longitudinally extending portions which are movable with respect to each other and which provide two separate control edges when turns are being made. A level-control means is provided for maintaining the two movable portions of the ski substantially parallel with one another, while allowing them to move up and down relative to each other. Skis of this type have the disadvantage that the tail portion is split and movable relative to each other and the further disadvantage of requiring a leveling device which increases the cost of the ski and complicates its use, since it is likely to freeze up under weather conditions commonly encountered in skiing. Such a ski is disclosed in the U.S. Pat. No. 3,549,162.

It has also been proposed, see, for example, U.S. Pat. No. 3,921,994, to split a ski into two parallel runners, each separately movable with reference to the other with an overlying binding portion and elastically-reacting links so that each runner can be vertically shifted with respect to the other runner and vice versa. This ski has the disadvantage that the ski bindings must be on a raised platform and that mechanical devices are required to keep the two runners parallel and to allow them to move relative to each other. Such devices increase the cost of the skis and increase the possibility of malfunctioning on the slopes.

OBJECTS OF THE INVENTION

It is an object of the invention to provide an improved ski of the class described. It is a further object of the invention to provide a ski having improved turning characteristics. It is a further object of the invention to provide a ski which is a unitary entity and yet has separate parallel ski runners. It is a further object of the invention to provide a ski having means for determining the distribution of pressure in the pressure zones. It is further object of the invention to avoid the disadvantages of the prior art and to obtain such advantages as will appear as the description proceeds.

BRIEF DESCRIPTION OF THE INVENTION

The invention relates to a ski having a tip portion, a tail portion, a boot support portion, and parallel runners unitarily united at the tip portion, the tail portion and the boot support portion and providing a channel running the full length of the bottom of the ski, the channel, forward and rearward of the boot support portion, being open from the bottom to the top thereof. If desired, there may be provided one or more bridges which span open portions of the channel which may be affixed to the top of the runners. Also, if desired, the portion of the channel under the boot support portion may be partially filled in.

More particularly, the invention relates to a ski having a tip portion bent up to form the ski shovel, a tail portion, a boot platform portion positioned to support and distribute the weight of the skier, a forward portion extending forwardly from said boot platform portion through said tip portion, and a rearward portion extending rearwardly from said boot platform portion to said tail portion, which ski comprises a pair of parallel runners separated from each other a distance equal to about 30 to about 50 percent of the mean width of the ski, and being rigidly and unitarily joined together at spaced intervals which include said tip portion and said tail portion, and a boot platform, thereby forming a running surface separated by a longitudinal channel running from the tip portion through the tail portion, which channel extends all the way through the ski in the areas where the runners are not joined together to form open channel portions, which open channel portions extend, in the forward portion, forward from the boot platform portion and rearward from the tip portion, and, in the rearward portion, rearward from the boot platform portion and forward from the tail portion, and, in the forward portion, constituting at least 50 percent thereof and, in the rearward portion, constituting at least about 60 percent thereof.

Advantageously, a reinforcing bridge spans the runners, leaving an open channel forward and rearward thereof, which bridge is rigidly and unitarily united with the runners, with the channel portion under the bridge having a depth equal at least to the thickness of the ski at that point. Preferably, the portions of the bridge united with the runners taper toward the front and feather into the top surfaces of the runners. If desired, a portion of the bridge opposed to the channel length slopes up to the front end thereof to provide a miniature shovel. It is an advantage also to cut back the bridge from its forward edge to expose the channel. Advantageously, a bridge is provided in the mid-portion of each of the forward and rearward portions.

In a preferred form of the invention, the channel extends forward only to a point adjacent to that at which the tip portion begins to bend up to form the shovel. This makes it possible for the shovel to push the snow down under the runners and yet allow it to fill said channel.

The sides of the channel in the forward and rearward portions may be normal to the running surfaces but, advantageously, flare outwardly along convex curves, one of which merges tangentially with the running surface of one of the runners and the other with the running surface of the other runners.

Advantageously, the curves are ellipsoidal with their major axes in the same plane, which plane is near to, below, and parallel to the upper surfaces of the runners, with their minor axes normal to the running surfaces of the runners at the points where the curves merge tangentially with the running surfaces, and with the major axes not more than about 50 percent greater than the minor axes.

In a preferred form of the invention, the portion of the channel underlying the boot platform portion is shallower than the thickness of the runners at that point, and tapers downwardly and rearwardly from the front edge of the boot portion to a nadir near the running surfaces of the runners and then slopes up to the rear edge of the boot platform portion. Advantageously, the nadir extends substantially parallel to the running surfaces of the runners over the major portion of the length of the boot platform portion. According to whether or not the channel underlying the boot platform is so constructed and depending on how far down in the channel the nadir is, the pressure zone characteristics can be modified without otherwise needing to change the construction of the ski. Also a ski having an unrestricted channel under the boot platform portion can have its pressure area characteristics modified by gluing, or otherwise fastening in the channel, an insert which will cause the channel to slope downwardly and rearwardly to a nadir and then slope up to the rear edge.

In a like manner, the pressure areas in the forward and rearward sections can be modified by adding bridges thereto or by the plane in which the bridges are added. By making the bridges easily removable and replaceable in different locations, the pressure areas can be shifted according to the individual's preference or according to the particular conditions obtaining on the slopes.

In the preferred form of the invention it is an advantage to have the shovel constitute between about 2 percent and 15 percent, the boot platform from about 20 to about 50 percent, the rearward portion from about 15 to about 40 percent, and the forward portion, less the shovel or tip, about 25 to about 50 percent of the overall length of the ski. The ski bindings will be placed on the boot saddle portion in accordance with the customary practice in the art. The boot platform portion need only be long enough to accommodate the ski bindings and the boots. In practice, however, it will be considerably longer in order to get the desired pressure distribution.

The ski according to the present invention is particularly suitable for experienced and racing skiers, since it is possible to concentrate the pressure area under the boot and at the same time to provide a high degree of flexibility in the forward and rearward portions, in order to reduce the pressure areas there. Also, the dual runners in the forward and rearward portions make it easier to execute tight, carved, parallel turns.

DETAILED DESCRIPTION OF THE INVENTION

Figures 1, 2, 3, 4, 5, 6, 7, 8:
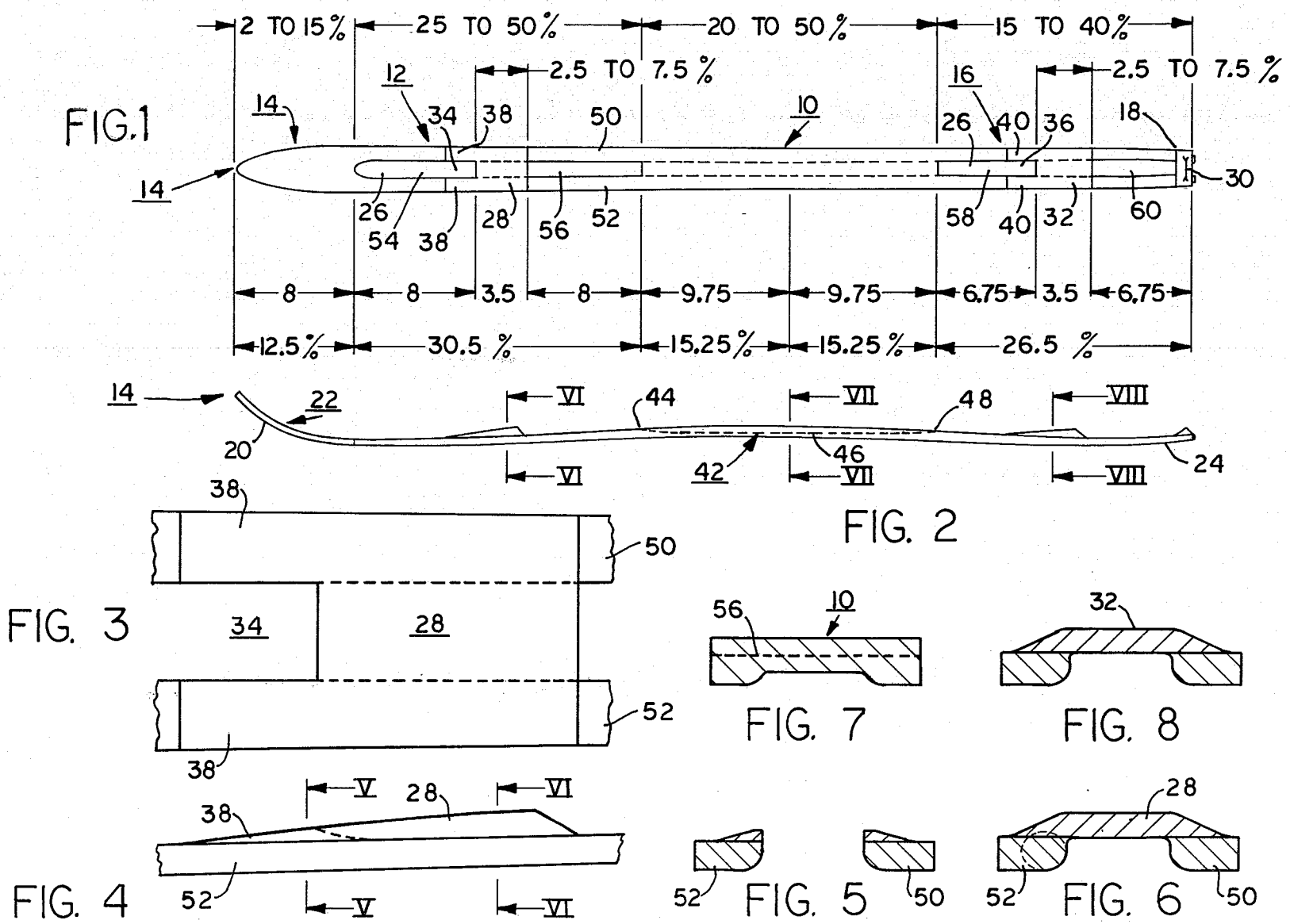
FIG. 1 shows a ski according to the invention, wherein the preferred dimensions are indicated in inches, by percentages, and by ranges of percentages.
FIG. 2 is a side elevation of FIG. 1.
FIG. 3 is a plan view of a detail of FIG. 1.
FIG. 4 is a side elevation of FIG. 3.
FIG. 5 is an enlarged cross-section taken along V—V of FIG. 4.
FIG. 6 is an enlarged cross-section taken along line VI—VI of FIGS. 2 and 4.
FIG. 7 is an enlarged cross-section taken along line VII—VII of FIG. 2.
FIG. 8 is an enlarged cross-section taken along line VII—VII of FIG. 2.

In FIGS. 1 and 2 there is shown a ski having a boot platform portion 10, a forward portion 12 including a tip 14, rearward portion 16 inclusing a tail 18. The tip portion is bent up at 20 to form a shovel 22 and the tail 18 is bent up slightly, as shown at 24.

The forward portion 12 has a longitudinal slot extending from the point adjacent where the tip begins to bend up to form the shovel back to the boot platform portion 10, and bridging the slot 26 is a bridge 28.

In the rearward portion 16, the slot 26 extends from the rear of the boot platform portion 10 through the end of the ski, which slot is bridged by bridge 30 bridging the tail of the ski and uniting the runner portions to the side of the slot in a unitary structure. The rearward portion 16 also has a bridge 32 bridging the slot 26 in the same manner that bridge 28 bridges slot 26 in the forward portion. In both cases, the slot under the bridges has a depth at least equal to the thickness of the ski at that point.

The bridges 28 and 32 are cut back at 34 and 36 respectively and the forward portions bordering the cutbacks taper forward and further into the upper surface of the ski, as more particularly shown in FIG. 4. The bridges 28, 30, and 32 can be fastened to the ski with removable fasteners or they can be glued thereto or formed as an integral part thereof. If the bridges 28 and 32 are removable, they can be removed to adjust the pressure zones of the ski or shifted forward or rearward for the same purpose.

The slot under the boot platform portion 10 is filled in, as shown by the dotted line 42 in FIG. 2. This filled-in portion slopes downward and rearward from the forward edge 44 of the boot platform portion 10 to a nadir 46 and then up again to the rear edge 48 of the boot platform 10. The nadir 42 extends over the major portion of the boot platform 10 and functions to increase the pressure under the boot platform portion and to help to concentrate the pressure zone thereunder. It will be understood, however, that the channel under the boot platform portion 10 can be unrestricted, just as the channel under the bridges 28, 30, and 32 is unrestricted.

There is thus provided a ski having parallel runners 50 and 52 which merge unitarily into a tip portion 14 or the shovel 22 into the bridge 30 at the tail 18, into the boot saddle portion 10, and into the bridges 20 and 32. The slotted channel 26 has a uniform width throughout the length of the ski which is equal to between about 30 and 50 percent of the mean width of the ski and provides open portions 54 and 56 forward and rearward of the bridge 32.

The sidewalls of the slot or channel 26 in the forward and rearward portions flare outwardly along convex curves, one of which merges tangentially with the running surface of one of the runners and the other of which merges tangentially with the running surface of the other runner, as shown more particularly in FIGS. 5, 6, and 8. A continuation of these convex curves will also be found in the restricted portion of the channel under the boot platform portion, as shown more particularly in FIG. 7. These convex curves, as best seen in FIG. 6, at 54, are elliptical in which their major axes are in the same plane, which plane is near to, below, and parallel to the upper surface of the runners. It is to be understood that in the illustrations, a demarcation is made between the runners and the bridges which delineates the upper surface of the runners, but that no such delineation would be present if the bridge and runners were an integral construction. Nonetheless, in such construction, the upper surface of the runners should be visualized for the purpose of the description. Thus, the major axes of each ellipse is near to, below, and parallel to the upper surface of the runner, and in the same plane with the major axis of the ellipse of the other runner. The minor axis of the ellipses are normal to the running surfaces of the runners at the place where the curves merge tangentially with the running surfaces. The major axis is only slightly larger than the minor axis and preferably not more than 50 percent greater. Suitably, the ellipse can be a 60 degree ellipse.

The dimensions given in FIG. 1 are for the purpose of illustration only and it will be understood that variations can be made therein to adapt the ski to the length of the skier and to the particular demands of the skier, according to his skill and ability. Advantageously, the shovel portion or tip portion constitutes about 2 to 15 percent of the overall length of the ski, the portion of the forward portion having open channels therein about 25 to 50 percent, the boot platform portion about 20 to 50 percent, and the rearward portion about 15 to 40 percent. The length of each bridge 28 and 32 advantageously constitutes about 2½ to 7 percent of the overall length of the ski.

It is to be understood that the invention is not to be limited to the exact details of operation or structure shown and described, as obvious modifications and equivalents will be apparent to one skilled in the art.

I claim:

1. A ski having a tip portion bent up to form the ski shovel, a tail portion, a boot platform portion positioned to support and distribute the weight of the skier, a forward portion extending forwardly from said boot platform portion through said tip portion, and a rearward portion extending rearwardly from said boot platform portion through said tail portion, which ski comprises:

a pair of parallel runners separated from each other a distance equal to about 30 percent to about 50 percent of the mean width of said ski and being rigidly and unitarily joined together at spaced intervals which include said tip portion, said tail portion, and said boot platform portion, thereby forming a running surface separated by a longitudinal channel running from said tip portion through said tail portion, which channel extends all the way through said ski in the areas where said runners are not joined together, to form open channel portions; said open channel portions extending, in said forward portion, forward from said boot platform portion and rearward from said tip portion, and, in said rearward portion, rearward from said boot platform portion and forward from said tail portion, and, in said forward portion, constituting at least about 50 percent thereof and, in the rearward portion, constituting at least about 60 percent thereof.

2. A ski of claim 1, which further comprises a reinforcing bridge which spans said runners leaving an open channel forward and rearward thereof, said bridge being rigidly and unitarily united with said runners and the channel portion under said bridge having a depth equal at least to the thickness of said ski at that point.

3. A ski of claim 2, in which the portions of said bridge united with said runners taper toward the front and feather into the top surfaces of said runners.

4. A ski of claim 3, in which the portion of the bridge opposed to said channel slopes up to the front end thereof.

5. A ski of claim 3, in which said bridge is cut back from its forward edge to expose said channel.

6. A ski of claim 5, in which one said bridge is provided in the mid-portion of each of said forward and rearward portions.

7. A ski of claim 6, in which said channel extends forward only to a point adjacent to that at which said tip portion begins to bend up to form said shovel.

8. A ski of claim 1, in which the sides of said channel in the forward and rearward portions spread outwardly along convex curves, one of which merges tangentially with the running surface of one of said runners and the other of which merges tangentially with the running surface of the other of said runners.

9. A ski of claim 8, in which said convex curves are elliptical; in which their major axes are in the same plane, which plane is near to, below, and parallel to the upper surfaces of said runners; in which their minor axes are normal to the running surfaces of said runners at the place where the curves merge tangentially with said running surfaces; and in which the major axes are not more than 50 percent greater than the minor axes.

10. A ski of claim 1, in which the portion of said channel underlying said boot platform has a depth less than the thickness of said runners at that point and tapers downwardly and rearwardly from the front edge of said boot platform to a nadir near the running surfaces of said runners and then slopes up to the rear edge of said boot platform portion.

11. A ski of claim 10, in which said nadir extends substantially parallel to the running surface of said runners over the major portion of the length of said boot platform portion.

12. A ski of claim 1, in which said shovel constitutes between about 2 percent to about 15 percent of the overall length of said ski and in which a portion of the open portion of said channel extends forward at least to the point where the tip portion begins to bend up to form said shovel.

13. A ski of claim 12, in which the length of said boot portion ranges from about 20 percent to about 50 percent of the overall length of said ski.

14. A ski of claim 1, which further comprises a reinforcing bridge which spans said runners leaving an open channel forward and rearward thereof, said bridge being rigidly and unitarily united with said runners and the channel portion under said bridge having a depth equal at least to the thickness of said ski at that point; in which the portions of said bridge united with said runners taper toward the front and feather into the top surfaces of said runners; in which said bridge is cut out at its forward edge to expose said channel; in which one said bridge is provided in the mid-portion of each of said forward and rearward portions; in which said channel extends forward only to a point adjacent to that at which said tip portion begins to bend up to form said shovel; in which the sides of said channel in the forward and rearward positions flare outwardly along convex curves, one of which merges tangentially with the running surface of one of said runners and the other of which merges tangentially with the running surface of the other of said runners; in which said convex curves are ellipsoidal; in which their major axes are in the same plane, which plane is near to, below, and parallel to the upper surface of said runners, and in which their minor axes are normal to the running surfaces of said runners at the point where the curves merge tangentially with said running surfaces, and in which the major axes are not more than 50 percent greater than the minor axes; in which the portion of said channel underlying said boot platform is shallower than the thickness of said runners at that point and tapers downwardly and rearwardly from the front edge of said boot platform to a nadir near the running surfaces of said runners and then slopes up to the rear edge of said boot platform portion; in which said nadir extends substantially parallel to the running surface of said runners over the major portion of the length of said boot platform portion; in which the length of said boot portion ranges from about 20 percent to about 50 percent of the overall length of said ski.

15. A ski of claim 1, in which, of the overall length of the ski, the shovel portion constitutes from about 2 to about 15 percent; the forward portion, from the boot platform portion to the shovel portion, constitutes from about 20 to about 50 percent; the boot platform portion constitutes from about 20 to about 50 percent; and, the rearward portion constitutes from about 15 to about 40 percent.

16. A ski of claim 15, in which the shovel portion constitutes about 12.5 percent; the forward portion from the boot platform to the shovel portion constitutes about 30.5 percent; the boot platform portion constitutes about 30.5 percent; and, the rearward portion constitutes about 26.5 percent.

17. A ski which has a tip portion, a tail portion, a boot support portion, and parallel runners unitarily united at the tip portion, the tail portion, and the boot support portion and providing a channel running the full length of the bottom of said ski, said channel, forward and rearward of the boot support portion, being open from the bottom to the top thereof.

18. A ski of claim 17, having at least one bridge affixed to the top of said runners and spanning an open portion of said channel.

19. A ski of claim 17, in which the channel portion under the boot support portion is partially filled in.

20. A ski of claim 18, in which the channel portion under the boot support portion is partially filled in.

* * * * *

UNITED STATES PATENT AND TRADEMARK OFFICE

CERTIFICATE OF CORRECTION

PATENT NO. : 4,340,241

DATED : July 20, 1982

INVENTOR(S) : Danial E. Crockett

It is certified that error appears in the above-identified patent and that said Letters Patent is hereby corrected as shown below:

Title Page - under "UNITED STATES PATENT [19]; "Crocket" should read -- Crockett --

- [76] Inventor:; "Crocket" should read -- Crockett --

Column 3, line 48, "plane" should read -- place --.

Signed and Sealed this

*Twenty-second* Day of *February 1983*

[SEAL]

*Attest:*

GERALD J. MOSSINGHOFF

*Attesting Officer*

*Commissioner of Patents and Trademarks*